US005181410A

United States Patent [19]

Lai

[11] Patent Number: 5,181,410

[45] Date of Patent: Jan. 26, 1993

[54] ALUMINUM MESH WITH HOLLOW RIBS AND THE RELATED WORKPIECE EXTRUDING DIE

[76] Inventor: Ching-Ming Lai, 3F-2, No. 450, Cherng Der Rd., Taipei, Taiwan

[21] Appl. No.: 728,375

[22] Filed: Jul. 11, 1991

[51] Int. Cl.[5] ..... B21C 25/04

[52] U.S. Cl. ..... 72/256; 72/269

[58] Field of Search ..... 72/254, 256, 264, 269; 29/6.1, 890.038, 890.05; 52/635, 670, 672

[56] References Cited

U.S. PATENT DOCUMENTS

| | | | |
|---|---|---|---|
| 2,190,494 | 2/1940 | Templin | 29/890.038 |
| 3,527,079 | 9/1970 | Braeuninger | 72/269 |
| 4,396,685 | 8/1983 | Jury | 29/6.1 |

FOREIGN PATENT DOCUMENTS

| | | | |
|---|---|---|---|
| 273610 | 11/1989 | Japan | 72/269 |

*Primary Examiner*—Lowell A. Larson

*Attorney, Agent, or Firm*—Bacon & Thomas

[57] ABSTRACT

An aluminum extruding die comprising a mother die unit having a plurality of tooth-form holes at the middle respectively connected with one another forming into an extruding outlet, and a daughter die unit having a plurality of raised blocks respectively fastened in the tooth-form holes with gaps respectively maintained therebetween for the extrusion therethrough of aluminum material form a hollow, panel-like aluminum workpiece having a plurality of elongated, hollow ribs and a plurality of connecting strips alternatively connected therebetween is disclosed. The hollow, panel-like aluminum workpiece is further stretched into an aluminum mesh having a plurality of hollow ribs with a plurality of open spaces defined therein.

3 Claims, 4 Drawing Sheets

ALUMINUM MESH WITH HOLLOW RIBS AND THE RELATED WORKPIECE EXTRUDING DIE

BACKGROUND OF THE INVENTION

The present invention relates to a structure of aluminium mesh and, more particularly, to a structure of aluminum mesh in which ribs are formed as a hollow structure. The present invention further extends to an aluminum workpiece extruding die for making such an aluminum workpiece which is to be further. stretched into an aluminum mesh with hollow ribs.

Various methods and machines have been disclosed for a stretching of a mesh. Examples include British Patent Nos. 1,601,015; 1,600,947; 1,588,197, and Japanese Patent Nos. 22,462; 7,264; 36,108; 24,021 and 13,186. According to the known methods of forming a mesh, a workpiece is first formed by the process of extrusion through an extruding machine. The workpiece thus obtained is then stretched by means of a mesh stretching machine to form the mesh. By means of the aforesaid methods or machines, a high production rate at low production cost can be achieved. Further, the mesh can be conveniently designed in any of a variety of patterns. However, the mesh which is made from aluminum material by any of the known methods can not be used for some special purposes to completely replace the mesh that is made of stainless steel tubes or other metal tubes. Because the ribs in an aluminum mesh are made in a solid structure which is weak against shearing or bending force, an aluminum mesh can not bear high pressure. Therefore, an aluminum mesh is not suitable for making door panels or reinforced window screens or, for making the face for a seat or fence. In case the ribs in a mesh are made in a hollow condition, the structural strength of a mesh is simultaneously improved. Further, when same amount of material is used for forming a mesh, more peripheral surface is provided with the one in which the ribs are made with a hollow structure than the one in which the ribs are made in solid structure. Because of more peripheral surface, the structural strength of the mesh which has hollow ribs is relatively stronger in structural strength. Because of the aforesaid reasons, the mesh which is made from aluminum material in solid structure can not completely replace the mesh which is made from other metals in hollow structure. This is why the mesh which is made of stainless pipes or other metal pipes is still widely accepted for various purposes even though its outer appearance is imperfect (because it is formed through welding process which will more or less damage its outer appearance).

SUMMARY OF THE INVENTION

The present invention has been accomplished under the circumstances in view. It is therefore, an object of the present invention to provide an aluminum mesh in which the ribs which define therein a plurality of open spaces are made in a hollow structure through a stretching process to reinforce the structural strength of the aluminum mesh.

It is another object of the present invention to provide an aluminum mesh which is strong in structure and inexpensive to manufacture.

It is still another object of the present invention to provide an aluminum workpiece extruding die for extruding aluminum material into aluminum workpieces that can be respectively stretched into an aluminum mesh having a plurality of hollow ribs connected together with a plurality of open spaces defined therein.

It is still another object of the present invention to provide an aluminum workpiece extruding die for extruding aluminum material into aluminum workpieces that can be conveniently connected with one another into an enlarged of aluminum workpiece assembly for stretching into an enlarged of aluminum mesh.

BRIEF DESCRIPTION OF THE DRAWINGS

The present invention will now be described by way of example with reference only to the annexed drawings, in which.

DETAILED DESCRIPTION OF THE PREFERRED EMBODIMENT

Figure 1:
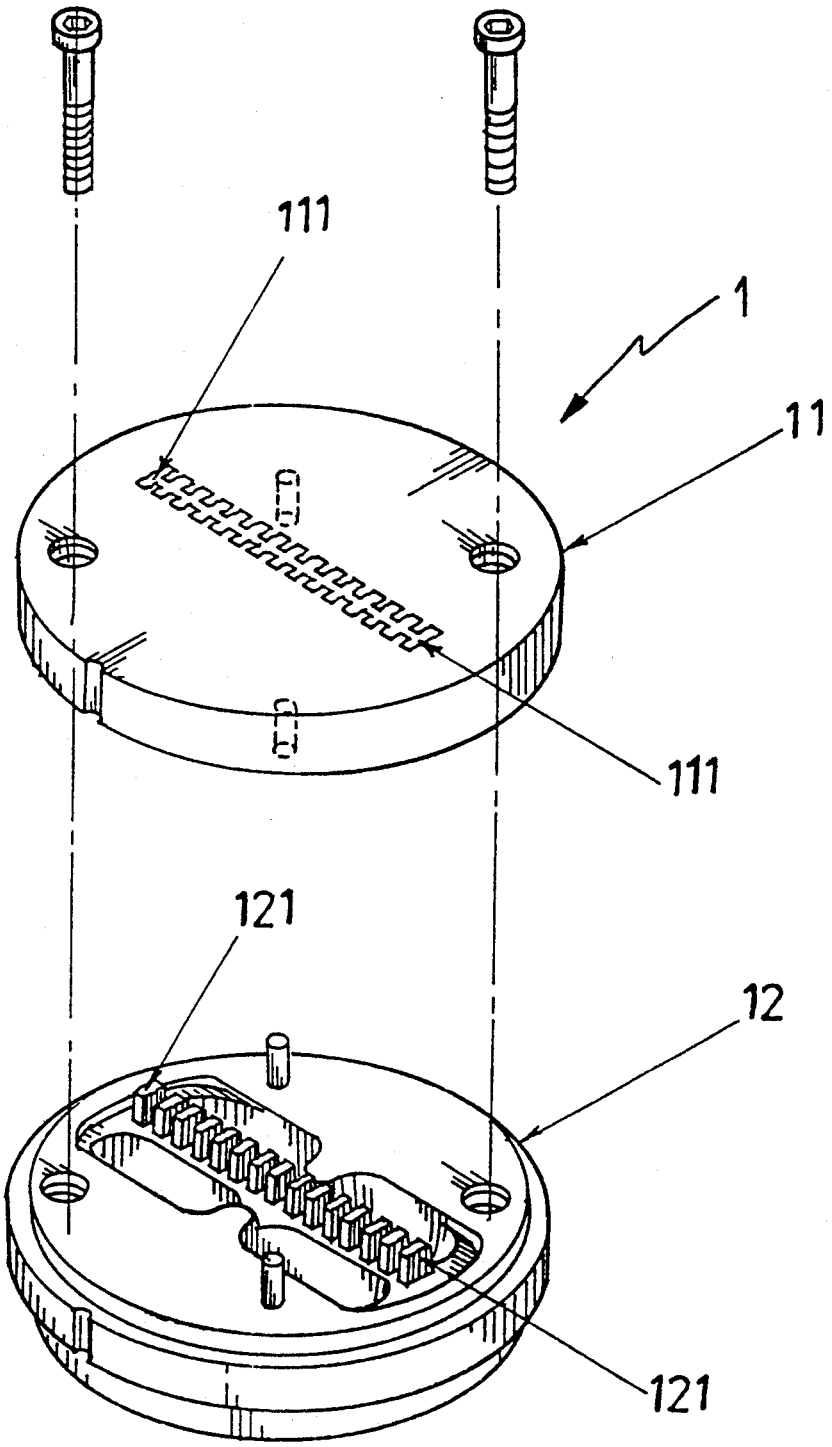
FIG. 1 is a dismantled perspective view of the aluminum workpiece extruding die embodying the present invention.

Referring to FIG. 1, an aluminum workpiece extruding die 1 which is generally comprised of a mother die unit 11 and a daughter die unit 12 is to be used in an aluminum extruding machine for making a hollow aluminum workpiece which is to be further stretched by a mesh stretching machine into an aluminum mesh. The mother die unit 11 has a plurality of tooth-form holes 111 at the middle respectively connected with one another forming into an extruding outlet for extruding the periphery of a workpiece. The daughter die unit 12 has a plurality of raised blocks 121 aligned at the middle. The size and number of the raised blocks 121 on the daughter die unit 12 are made to match with the tooth-form holes 111 on the mother die unit 11. When the mother die unit 11 is mounted on the daughter die unit 11, the raised blocks 121 are respectively inserted in the tooth-form holes 111 with gaps respectively maintained therebetween for extruding a hollow, panel-like workpiece which has a plurality of hollow ribs and a plurality of connecting strips alternatively connected therebetween. The raised blocks 121 are respectively designed on the daughter die unit 12 at a polar angle position relative to the tooth-form holes 111 so that they are forced into correct position in the tooth-form holes 111 by the squeezing force from feeding material during an extrusion process. This polar angle or taper configuration is clearly indicated by viewing the shape of the hollow portion of the extruded panel as depicted in either FIG. 3*b* or 4.

Figure 2:
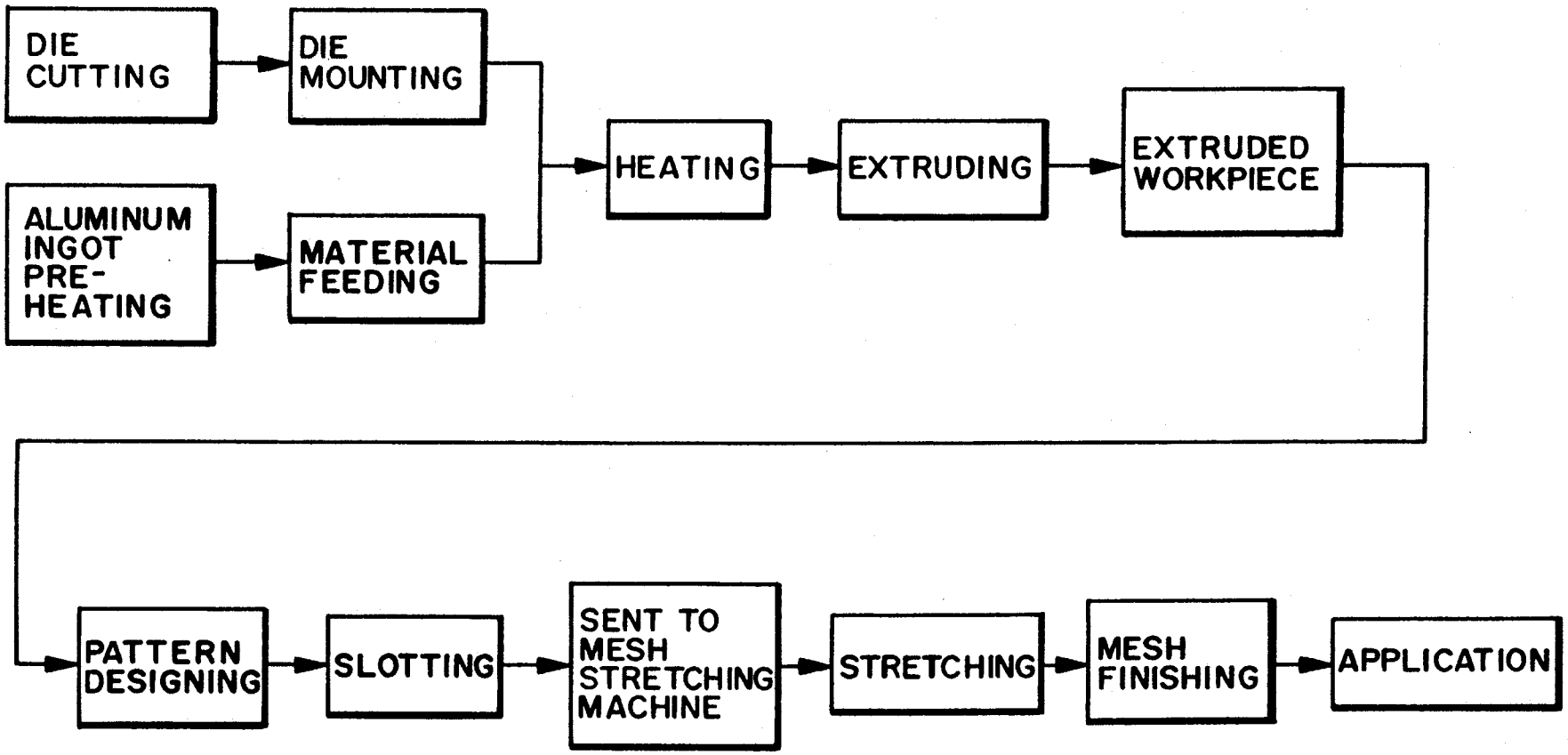
FIG. 2 is an aluminum mesh production flow chart according to the present invention.
Figure 3A:
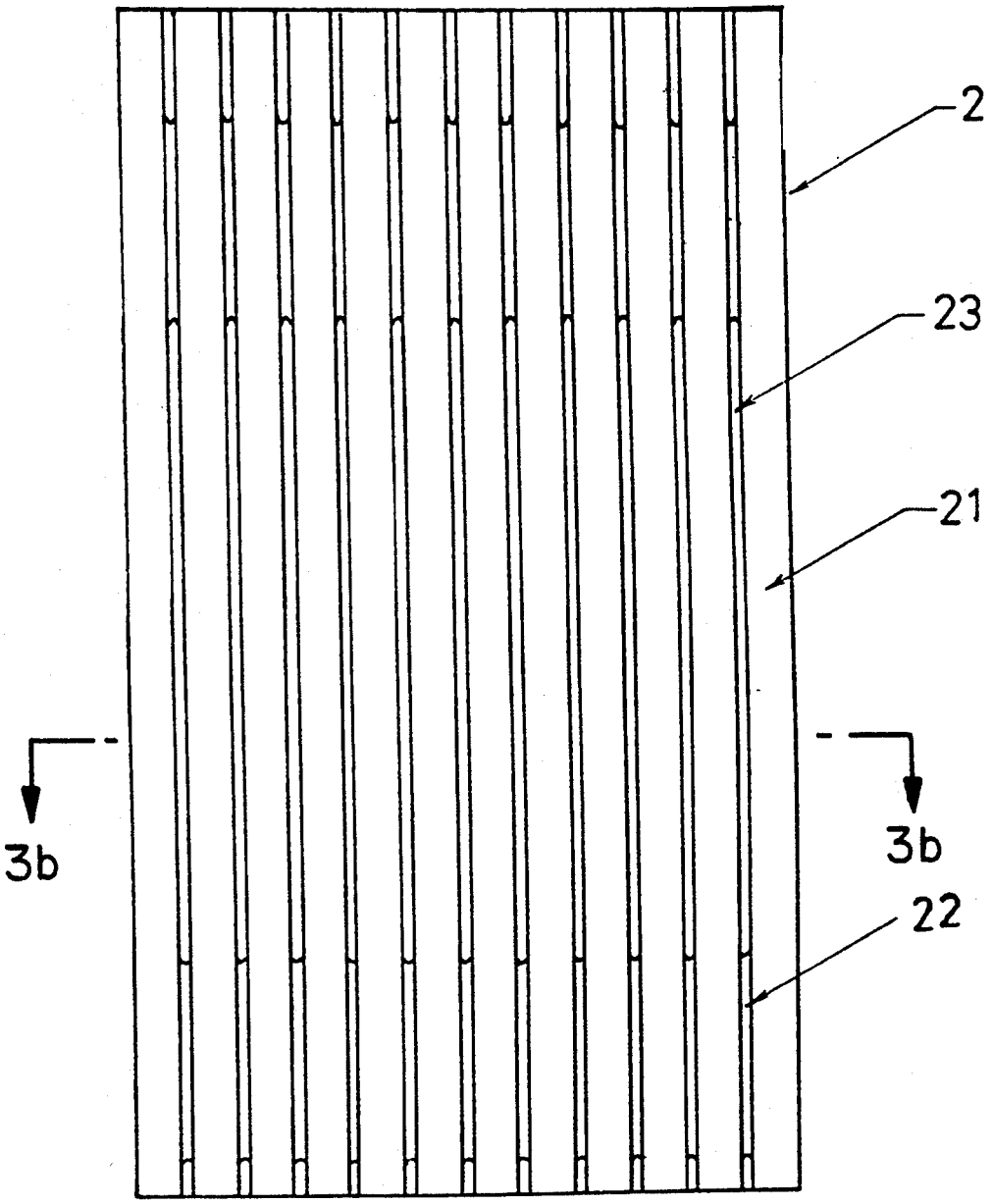
FIG. 3*a* illustrates an aluminum mesh made according to the present invention.
Figure 3B:
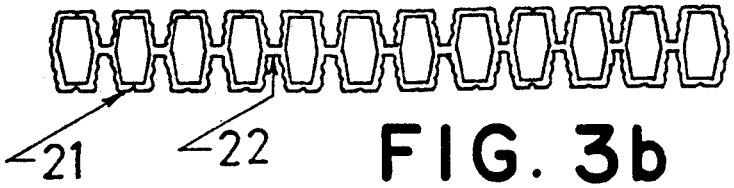
FIG. 3 *b* is a cross-sectional view taken along line 3*b*—3*b* in FIG. 3*a*.

Referring to FIG. 2 which illustrates the production flow chart of the present invention. An aluminum ingot, after having been properly cut and pre-heated, is sent into the feed pipe in an extruding machine where it is heated and then squeezed through the extruding die 1 forming into an extruded workpiece. When having been extruded out of the tooth-form holes 111, an extruded workpiece 2 is formed into a hollow panel, as illustrated in FIGS. 3*a* and 3*b*, having a plurality of hollow ribs 21 respectively connected with one another by connecting strips 22. The extruded workpiece 2 is then treated through pattern designing and slotting process to have elongated slots 23 on the connecting strips 22 thereof according to pre-determined patterns. After slotting, the extruded workpiece 2 is further delivered to a mesh stretching machine to be further stretched into an aluminum mesh with hollow ribs.

Figure 4:
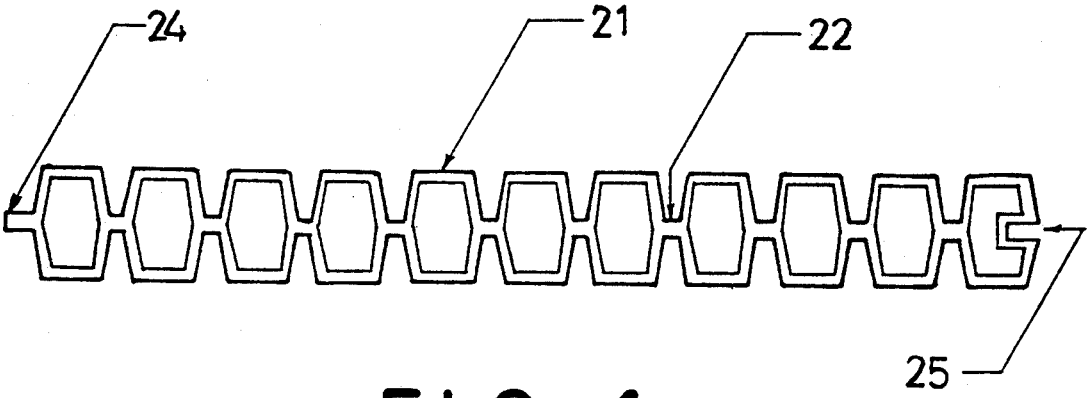
FIGS. 4, 5 and 6 illustrate several alternate forms of the aluminum workpiece coupling structure.
Figure 5:
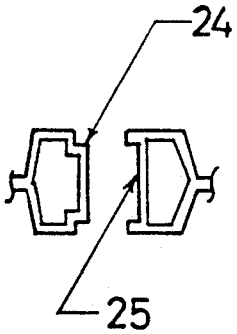
Figure 6:
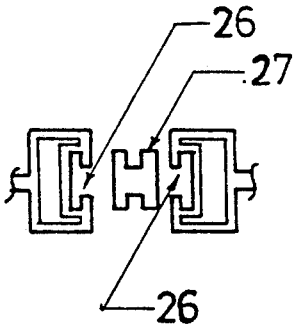

Because of the limitation of the aluminum workpiece extruding die 1, the size of an extruded workpiece is limited. In order to obtain a large aluminum mesh, several aluminum workpieces extruded through the aluminum workpiece extruding die 1 may be coupled with one another into a unitary piece for stretching into a large aluminum mesh. Referring to FIG. 4, a hollow, panel-like workpiece which is formed using an aluminum workpiece extruding die made according to the present invention is shaped like a hollow panel having a plurality of hollow ribs and a plurality of connecting strips alternatively connected therebetween, wherein the hollow rib at one side has a unitary male fastening member 24 at the outer side and the hollow rib at the opposite side has a unitary female member 25 at the outer side. By fastening the male fastening member 24 on one hollow, panel-like workpiece with the female fastening member 25 on another hollow, panel-like workpiece, a plurality of hollow, panel-like workpieces are coupled into a unitary, hollow, panel-like workpiece assembly. The male and female fastening members 24 and 25 may be variously shaped. FIG. 5 illustrates an alternate design of the male and female fastening members. In another alternate form of the present invention, the two hollow ribs at the two opposite sides of an extruded aluminum workpiece are respectively formed with an elongated retaining notch 26 longitudinally disposed at an outer side. By means of an elongated connecting bar 27 (which is separately made), two extruded aluminum workpieces can be conveniently coupled into an enlarged aluminum workpiece assembly.

What is claimed is:

1. An extrusion die for use in an aluminum extrusion process comprising:

a first die unit formed with a plurality of aligned tooth-form holes in a middle portion thereof, said tooth-form holes being interconnected to form a unitary die extrusion outlet; and a second die unit having a plurality of raised blocks which are aligned and spaced across a middle portion of said second die unit, at least some of said raised blocks having a cross-sectional lateral dimension at a central portion thereof greater than their opposing ends to define portions which taper from the central portion toward their opposing ends, wherein when said second die unit is secured to said first die unit, said plurality of raised blocks extend within said plurality of aligned tooth-form holes with gaps thereabout such that when a material is extruded through the gaps, the tapered portions of said at least some of said raised blocks function to correctly position the plurality of raised blocks within the tooth-form holes and a panel-like workpiece can be formed having a plurality of uniform, elongated hollow ribs joined by connecting strips.

2. A method of making an aluminum mesh by extruding aluminum through a die having a first die unit formed with a plurality of aligned tooth-form holes in a middle portion thereof which are interconnected to form a unitary die extrusion outlet and a second die unit having a plurality of raised blocks which are aligned and spaced across a middle portion of the second die unit and wherein at least some of the raised blocks have a cross-sectional lateral dimension at a central portion thereof greater than their opposing ends to define portions which taper from the central portion toward their opposing ends such that when the first and second die units are secured together, the plurality of raised blocks extend within the plurality of aligned tooth-form holes with gaps thereabout, comprising forcing material through the gaps between the plurality of raised blocks and the plurality of aligned tooth-form holes so that the tapered portions correctly position the plurality of raised blocks within the tooth-form holes and a panel-like workpiece having a plurality of uniform, elongated hollow ribs joined by connecting strips is formed.

3. The method of making an aluminum mesh as claimed in claim 2, further comprising stretching the formed panel-like workpiece.

* * * * *